United States Patent [19]

Bettcher

[11] 4,142,291

[45] Mar. 6, 1979

[54] TRIMMING KNIFE

[75] Inventor: Louis A. Bettcher, Amherst, Ohio

[73] Assignee: Bettcher Industries, Inc., Birmingham, Ohio

[21] Appl. No.: 842,585

[22] Filed: Oct. 17, 1977

[51] Int. Cl.[2] ..... B26B 29/00

[52] U.S. Cl. ..... 30/276

[58] Field of Search ..... 30/276, 293, 264, 286, 30/43.4; 17/1 R, 1 G

[56] References Cited

U.S. PATENT DOCUMENTS

| | | | |
|---|---|---|---|
| 2,827,657 | 3/1958 | Bettcher | 30/264 X |
| 3,197,808 | 8/1965 | Mears | 17/1 G |
| 3,461,557 | 8/1969 | Behring | 30/276 |
| 3,688,403 | 9/1972 | Bettcher | 30/276 |

*Primary Examiner*—Jimmy C. Peters

*Attorney, Agent, or Firm*—Watts, Hoffmann, Fisher & Heinke, Co.

[57] ABSTRACT

A manually held and manipulated knife for trimming a comestible product such as meat having a frame or frame assembly including a hand grasp or handle part extending radially outwardly from a ring-like part of short axial length and of considerable greater diameter than its axial length, a power driven ring-like blade also of short axial length rotatably supported in the ring-like part of the handle and having a radially inwardly facing circular cutting edge at one axial end, and a ring-like depth of cut control or gauge member within the blade and connected to the frame assembly for adjustment lengthwise of the axis of the blade by screws located radially outwardly of the gauge member. Clearance is provided between the blade and the depth of cut control or gauge member which clearance increases in the direction away from the cutting edge of the blade. The part of the depth of cut control or gauge member spaced from its connection to the frame assembly is flexible.

7 Claims, 2 Drawing Figures

TRIMMING KNIFE

BACKGROUND OF THE INVENTION

1. Field of the Invention

The invention relates to manually manipulatable knives having power driven ring-like blades which knives are used for trimming comestible products; especially meat, principally in the packing house and meat distribution industries.

2. Description of the Prior Art

Manually manipulable knives having a power driven ring-like cutting blade and a depth of cut gauges are known but the capabilities of these prior knives are limited and are not entirely satisfactory for many operations such as, trimming fat, skin, membrane, or the like, from meat products, for example, hams. Knives of the character mentioned are disclosed in U.S. Pat. Nos. 3,461,557 and 3,688,403 which patents are believed to disclose the most pertinent prior art known to applicant.

Some additional patents in the art to which the present invention belongs are U.S. Pat. Nos. 2,827,657; 3,024,532; U.S. Pat. No. Re. 25,947; U.S. Pat. Nos. 3,269,010; 3,852,882 and some of the references cited therein including German Pat. No. 1,064,216.

The knife shown in U.S. Pat. No. 3,461,557 has a disk supported in the opening of an annular power driven blade supported in an annular part of the frame or body of the knife which includes a generally round handle extends in a radial direction. The handle lies generally in the plane of the annular ring-like blade. The disk is supported and adjusted axially of the blade by structure located within the circumference of the blade and extending a considerable distance axially of the blade and is purported to serve as a depth of cut control or gauge when the knife is moved over a work body with the plane of the knife blade inclined slightly upwardly therefrom. The periphery of the depth of cut control disk closes the opening through the annular or ring-like parts of the knife except for an inadequate space about it periphery through which space a slice cut from the product being trimmed passes. The disk obviously obstructs the operatives view of the product where a slice is to be taken.

The mechanism for adjusting the depth of cut control or gauge member of the knife of U.S. Pat. No. 3,688,403 extends, as does, the corresponding mechanism shown in U.S. Pat. No. 3,461,557, a considerable distance axially above the blade and interferes with the attractiveness of the knife and its use. The configuration of the space between the blade and the gauge is such that parts trimmed from a product are not adequately guided therethrough and in some instances tend to accumulate therein, thus reducing the effectiveness of the knife. The present knife is of a more simplified design than the prior knives, has a cross sectional shape relative to the blade which facilitates the passage of trimmed parts of the product between the gauge and the blade has a better appearance, has greater in use capabilities than prior knives and is otherwise considered a major improvement of the prior knive especially for certain trimming operations and it is believed that it will be well accepted in the packing house and other meat processing industries.

SUMMARY OF THE INVENTION

The invention provides a novel and improved manually manipulable knife comprising a frame or frame assembly including a handle projecting radially from a ring-like structure of short axial length which supports therein a power driven ring-like blade also of short axial length relative to its diameter having an annular cutting edge at one end, and a ring-like depth of cut control or gauge assembly within the knife blade connected to the frame assembly of the knife adjacent to the handle part and adjustable axially of the knife blade as a unit by devices or structures located for the most part radially outwardly of the gauge member proper and within the dimensions of the knife axially of the blade. The gauge member proper, that is, the part of the gauge member spaced from its connection to the frame of the knife is flexible and the side thereof adjacent to the blade is generally conical diverging outwardly in the axial direction of the non-cutting end of the blade from a planar surface, thus providing clearance between the blade and the gauge which increases in the direction away from the cutting edge of the blade and thereby facilitates the passage of trimmed portions of the product between the blade and the gauge.

The invention also provides a novel and improved gauge of the character referred to for a manually manipulable knife comprising a handle extending radially from a ring-like structure supporting a power driven ring-like blade of short axial length having a cutting edge at one end by the use of which gauge the thickness of a cut made by the knife can be readily varied and controlled by the operator.

The invention resides in certain constructions and combination of parts and further objects and advantages of the invention will be hereinafter referred and/or will become apparent from the preferred embodiment shown in the accompanying drawing and hereinafter described.

DESCRIPTION OF THE PREFERRED EMBODIMENT

Figure 1:
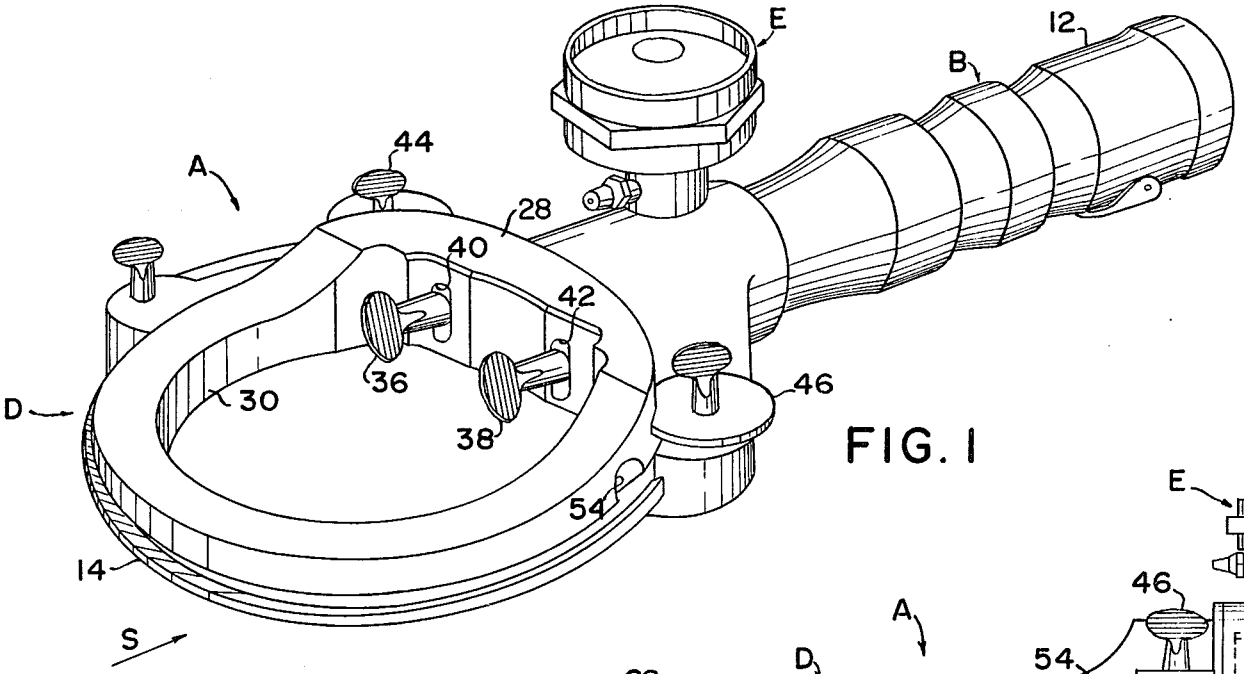
FIG. 1 is a prospective view of a knive embodying the present invention and representing the preferred embodiment of the invention; and, FIG. 2 is a side elevational view of the knife shown in FIG. 1 with parts in section approximately along the line 2—2 of FIG. 1.
Figure 2:
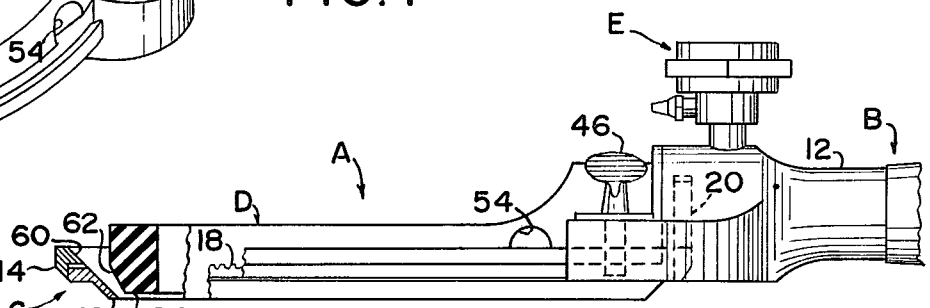

The knife shown in the drawing is designated generally by the reference character A and comprises a frame or frame assembly B having a tubular handle part 12 projecting radially outwardly from a ring-like part 14. A ring-like annular blade C is rotatably supported in the part 14 of the frame B. Both the part 14 of the frame B and the blade C are of short axial length compared to their diameters, preferrably about 1 to 15, and the blade has a radially inwardly facing annular peripherial cutting edge 16 at one end which end extends a short distance below the part 14 of the frame B and within which frame the other end of the blade is rotatably supported. The end of the blade opposite its cutting edge is provided with annular gear teeth 18 by which the blade C is driven from a power actuated gear 20 in the handle part of the frame B in a known manner.

The parts of the depicted knife A thus far mentioned are similar to the corresponding parts of the knife disclosed in the aforesaid U.S. Pat. No. 3,688,403, the disclosure of which is incorporated herein by reference. The important differences between the knife disclosed in said U.S. Pat. No. 3,688,403 and the knife of the present invention are the depth of cut control or gauge members of the respective knives and the manner of their connections to the frame assemblies of the knives.

The knife A incorporates an annular tubular-like depth of cut control or gauge member designated D comprising a base part 28 at one side connected to the frame B and a ring-like gauge proper or product contacting part 30 concretic with the blade C. The base part 28 of the gauge is of about twice the axial length of the gauge part 30 in the direction of the axis of the blade C and extends through an arc of about 30° to 40°. The base part 28 of the gauge D is connected to the assembly B by two wing headed screws 36, 38 extending generally lengthwise of the handle part 12 of the frame assembly B through two circumferentially spaced axially extending slots 40, 42 in the part 28 and threaded into tapped apertures in the handle part of the frame assembly B. The slots 40, 42 permit axial adjustment of the gauge D relative to the frame B.

In the depicted knife the gauge member D can be moved axially of the blade C by two flanged screws 44, 46 located radially outwardly of the gauge member and threaded into suitably tapped apertures in parts of the handle assembly extending to the right and left a short distance circumferentially of the blade C. The flanges of the screws 44, 46 project into slots 50 in the base part 28 of the gauge member D. Prior to adjusting the gauge member D towards or from the cutting edge 16 of the blade C the screws 36, 38 are preferably loosened and after the adjustment is made the screws 36, 38 can be again tightened.

The gauge member is preferably provided with an aperture 54 adjacent to the flanged screw 46 which aperture is of sufficient size to permit the insertion of a sharpening steel or stone therethrough when an operative wishes to sharpen the blade C.

In trimming a comestible product, such as, a ham, a right handed operative typically moves the knife from left to right or in the direction of the free end of the handle of the knife or in the general direction indicated by the arrow S in FIG. 1 and, because of the flexibility of the part 30 of the gauge member the operative by pressing the free end of the knife harder or less hard on the product being trimmed can very the thickness of the slice cut or trimmed from the product a greater or less amount depending upon the flexibility of the gauge member.

The inside surface 60 of the knife blade C which surface is preferably conical preferably makes an angle of about thrity degrees (30°) to about forty five degrees (45°) with the plane of the cutting edge 16 and the radially outer surface 62 of the part 30 of the gauge assembly D near the cutting edge of the blade and which is also conical makes an angle of about fifty degrees (50°) to about seventy degrees (70°) preferably about sixty degrees (60°) with the plane of the cutting edge of the blade on the end surface 64 of the gauge member nearest to the cutting edge of the knife which end is also planar. The gap provided between the adjacent surfaces 60 of the knife blade C and 62 of the part 30 of the gauge assembly D diverge in the direction away from the cutting edge 16 of the blade by an angle of from about ten degrees (10°) to about thirty degrees (30°) to allow a slice trimmed from a product to pass freely upwardly between the blade and the gauge member. The angles mentioned above are merely representative of angles which may possibly employed which angles may very for different knives depending upon the diameters of the blades employed, the type of product being operated upon the surface of the gauge member D adjacent to the cutting edge 16 of the blade C is normally planner and parallel with the plane of the cutting edge 16. This results in a sharp or distinct corner at the edge of the gauge member adjacent to the cutting edge of the blade which construction is an improvement over the rounded construction of the prior art.

The part of the depicted knife A designated by the reference character E is merely a conventional device for periodically lubricating the driving gearing for the blade. The metal parts of the apparatus for the most part are made of corrosive resistant steel and the gauge assembly D is preferably made of a suitable nontoxic or edible plastic which has the necessary flexability, for example, a high density polyethylene or Nylon. The use of such a plastic is particularly advantageous as they are nonporous, will not absorb bacteriaa, are highly resistant to acids and alkalines, have a clean appearance, become white with age, have low coefficients of friction, and are easily cleaned.

From the foregoing description of the preferred embodiment of the invention it will be apparent that the objects heretofore mentioned and others have been accomplished and that there has been provided a novel and improved depth of cut gauge and knife of the character referred to incorporating such a gauge which provides the operative with a relative unobstructed view of the products being sliced or trimmed and control over the thickness of a slice trimmed from the product.

While the preferred embodiment of the invention have been illustrated and described in considerable detail the depicted knife is merely illustrative of the invention and may be modified in many ways within the scope of the invention. The cross sectional shape of the knife and/or the product contacting part of gauge assembly, for examples, may be varied as desired and various power sources may be employed to drive the knife blade, etc.

It is the intention to hereby cover all adaptations modifications and uses of the depicted knife which come with the skill of those to which the invention relates and the scope of the following claims.

What is claimed is:

1. A gauge for a hand-held and manipulated knife for trimming a comistable product, such as, meat, and having a handle projecting radially from an annular ring-like member of short axial length in which a ring-like blade of short axial length having an annular cutting edge at one end is rotatably supported and power driven, said gauge assembly comprising an annular tubular-like member having a base part at one side adapted for connection to the knife and a flexible ring-like gauge part proper integral with said base part, at least one end of said gauge member being planar and joined by an exterior conical surface diverging therefrom.

2. A gauge as claimed in claim 1 in which said conical surface of said gauge member diverges from said planar end surface of said gauge member at an angle of from about 110° to 130°.

3. A gauge as claimed in claim 1 in which said conical surface of said gauge member diverges from said planar end thereof at an angle of about 120°.

4. A hand-held and manipulated knife for trimming a comistable product such as, meat and having a frame assembly including a handle projecting radially from an annular member of short axial length in which a ring-like blade of short axial length having an annular cutting edge at one end is rotatably supported and power driven, a gauge assembly comprising an annular tubular-like member within and concentric with said blade and having a base part at one side connected to said frame assembly of said knife and a flexible ring-like gauge part proper connected to said base part, the end of said gauge member adjacent to the cutting edge of said blade being planar and joined by an exterior conical surface diverging therefrom and spaced from the interior surface of said blade to provide a gap or space between said blade and said gauge member for the passage of a slice therethrough and means for adjusting said gauge member axially of said knife blade.

5. A knive as claimed in claim 4 in which said conical surface of said gauge member diverges from said planar end thereof at an angle of from about 110° to 130°.

6. A knife as claimed in claim 4 in which said conical surface of said gauge member diverges from said planar end thereof at an angle of about 120°.

7. A knife as claimed in claim 4 in which said means for adjusting said gauge member axially of said blade comprises at least one flanged threaded fastener in a tapped aperture in the frame assembly of the knife the flange of which fastener engages in a slot in the circumference of the base part of the gauge member, said flanged fastener being radially outwardly of the gauge member.

* * * * *